US006052948A

United States Patent [19]

Spitzley

[11] Patent Number: 6,052,948

[45] Date of Patent: Apr. 25, 2000

[54] SNAP-ON DOOR HANDLE ASSEMBLY

[75] Inventor: Larry W. Spitzley, Mulliken, Mich.

[73] Assignee: ADAC Plastics, Inc., Grand Rapids, Mich.

[21] Appl. No.: 09/221,375

[22] Filed: Dec. 28, 1998

[51] Int. Cl.[7] ..... E05B 1/06

[52] U.S. Cl. ..... 49/460; 49/506

[58] Field of Search ..... 49/503, 506, 502, 49/460; 403/329, 353

[56] References Cited

U.S. PATENT DOCUMENTS

| | | | |
|---|---|---|---|
| 1,505,380 | 8/1924 | Dexter . | |
| 3,117,339 | 1/1964 | Vigna . | |
| 3,273,844 | 9/1966 | Hodson et al. . | |
| 3,315,998 | 4/1967 | Dallaire . | |
| 3,710,972 | 1/1973 | Barry . | |
| 3,848,764 | 11/1974 | Saig . | |
| 4,063,660 | 12/1977 | Ware . | |
| 4,363,420 | 12/1982 | Andrews . | |
| 4,438,964 | 3/1984 | Peters . | |
| 4,470,624 | 9/1984 | Bisbing . | |
| 4,872,366 | 10/1989 | Appleby et al. . | |
| 4,949,508 | 8/1990 | Elton . | |
| 5,101,597 | 4/1992 | Pelachyk et al. | 49/460 |
| 5,183,302 | 2/1993 | Pelachyk et al. . | |
| 5,263,750 | 11/1993 | Smith et al. . | |
| 5,355,554 | 10/1994 | Magoon . | |
| 5,758,454 | 2/1998 | Trap et al. | 49/506 |

*Primary Examiner*—Daniel P. Stodola
*Assistant Examiner*—Curtis A. Cohen
*Attorney, Agent, or Firm*—Young & Basile, P.C.

[57] ABSTRACT

A method of attaching a vehicle door handle to the a vehicle door, and a door handle assembly to facilitate such attachment. The door skin includes a plurality of individual, spaced apertures. The door handle assembly includes a handle member, a base plate pivotally mounting the handle member and defining a planar surface, a plurality of lugs on the base plate each sized to pass through a respective aperture and each defining a web portion extending outwardly from the planar surface, and a flange portion rigid with the web portion and a spring clip device on the base plate biased outwardly from the planar surface and including a latching free edge. With each lug positioned in alignment with a respective aperture the spring clip is offset with respect to its associated aperture so that the door assembly may be mounted on the skin by placing the door handle assembly on the skin with the planar surface of the base plate juxtaposed to an outer surface of the skin, the lugs passing through a respective apertures, and the spring clip biased against a portion of the skin outer surface adjacent its associated aperture and thereafter moving the door handle assembly relative to the skin to move the web portion of each lug into engagement with an edge portion of a respective aperture, move the flange portion of each web beneath an inner surface of the skin and snap the clip free edge into engagement with the latching edge of the associated aperture.

8 Claims, 3 Drawing Sheets

SNAP-ON DOOR HANDLE ASSEMBLY

BACKGROUND OF THE INVENTION

This invention relates to motor vehicle door handle assemblies and more particularly to a method of attaching a motor vehicle door handle assembly to the associated motor vehicle door structure.

Motor vehicles typically include one or more doors providing access to the interior of the vehicle and at least one door handle assembly mounted on an interior and/or exterior surface or skin of each door to control the opening and closing of the door. The door handle assembies are typically attached to the associated door utilizing various fastener mechanisms and various tools. Although the fastener mechanisms and tools are effective in securing the door handle assembly to the door, they require that a considerable amount of high priced labor be expended in attaching each door handle assembly to each associated door. In an effort to minimize the required labor, door handle assemblies have been proposed which allow the handle assembly to be attached to the door without the use of separate fastening devices or tools and with a minimum of labor. See for example U.S. Pat. No. 5,758,454 assigned to the Assignee of the present invention and U.S. Pat. No. 5,183,302. This invention provides an alternate method and structure for fastening a motor vehicle door handle assembly to a motor vehicle door without the use of fasteners or tools and with a minimum of labor.

SUMMARY OF THE INVENTION

This invention is directed to the provision of an improved method and structure for attaching a motor vehicle door handle assembly to a motor vehicle door.

More particularly, this invention is directed to the provision of an improved method and structure for attaching a motor vehicle door handle assembly to a motor vehicle door without the use of separate fastening devices and without the use of tools.

The invention provides a method of mounting a motor vehicle door handle assembly on a skin of a door assembly of a motor vehicle wherein the handle assembly includes a handle member and a base plate defining a planar surface. According to the invention, a plurality of individual, spaced lug apertures and a separate spaced clip aperture are provided in the door skin; a plurality of lugs are provided on the handle base plate each sized to pass through a respective lug aperture in the door skin and each defining a web portion extending outwardly from the planar surface and a flange portion rigid with the web portion and spaced outwardly from the planar surface by at least the thickness of the door skin; a spring clip device is provided on the handle base plate biased outwardly from the planar surface and including a latching free edge for latching coaction with a latching edge of the clip aperture, the spacing and orientation of the lug and clip apertures relative to the spacing and orientation of the lugs and the spring clip being such that with each lug positioned in alignment with a respective lug aperture the spring clip is off-set with respect to the clip aperture; the door handle assembly is placed on the door skin with the planar surface of the base plate juxtaposed to an outer surface of the skin, the lugs passing through respective lug apertures, and the spring clip biased against a portion of the skin outer surface adjacent the clip aperture; and the door handle assembly is moved relative to the skin in a direction to move the web portion of each lug into engagement with an edge portion of a respective lug aperture, move the flange portion of each web beneath an inner surface of the skin proximate the respective lug aperture, and snap the free edge of the spring clip into latching engagement with the latching edge of the clip aperture. This methodology allows the handle assembly to be mounted on the door without the use of separate fastening devices, without the use of special tools, and with a minimum of labor.

According to a further feature of the invention, two laterally spaced lugs are provided proximate one end of the base plate, at least one lug is provided proximate another end of the base plate, and the spring clip device is provided proximate the one end of the base plate between the two laterally spaced lugs. This specific map of the apertures, lug and spring device provides a simple but yet firm interlocking coaction between the door assembly and the door skin.

According to a further feature of the invention, the base plate is formed as a molded plastic product, including a main body planar section, and the spring clip device is positioned in an aperture in the main body planar section of the base plate and is connected to the main body planar section of the base plate by a live hinge. This specific live hinge construction provides a positive snap action assembly while minimizing the cost of the assembly.

According to further feature of the invention, the clip aperture in the door skin coacting with the spring clip device defines a notch or cut-out in an edge thereof opposite the latching edge and the spring clip device includes a post that is received in the cut-out with the spring clip in latching engagement with the door skin. The coaction between the post and the cut-out ensures that the clip aligns precisely with the latching edge of the clip aperture and discourages inadvertent dislodgement of the spring clip from the door skin.

DETAILED DESCRIPTION OF THE PREFERRED EMBODIMENT

The invention methodology and structure are especially suitable for attaching a motor vehicle door handle assembly to the inner or outer skin of a motor vehicle door.

Figure 1:
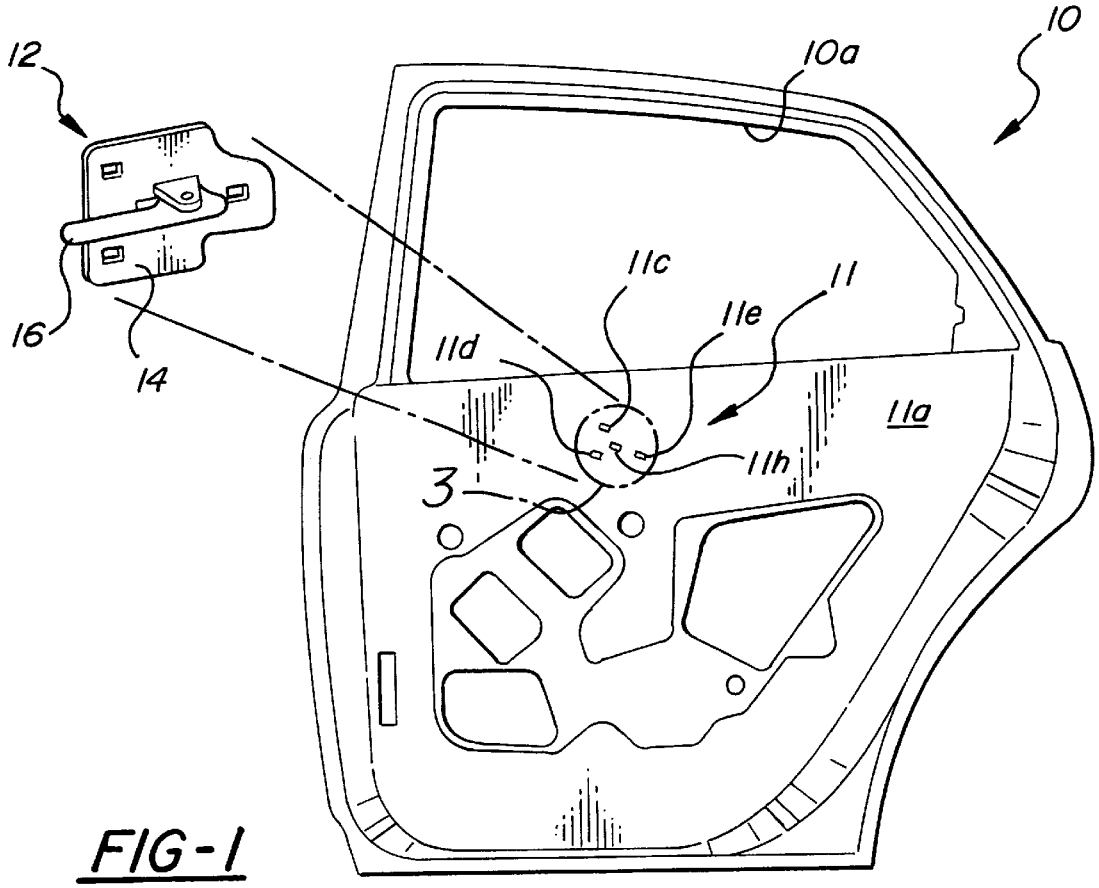
FIG. 1 is a perspective view of a motor vehicle door including a motor vehicle door handle assembly according to the invention shown in exploded relation with respect to an associated skin of the door.
Figure 2:
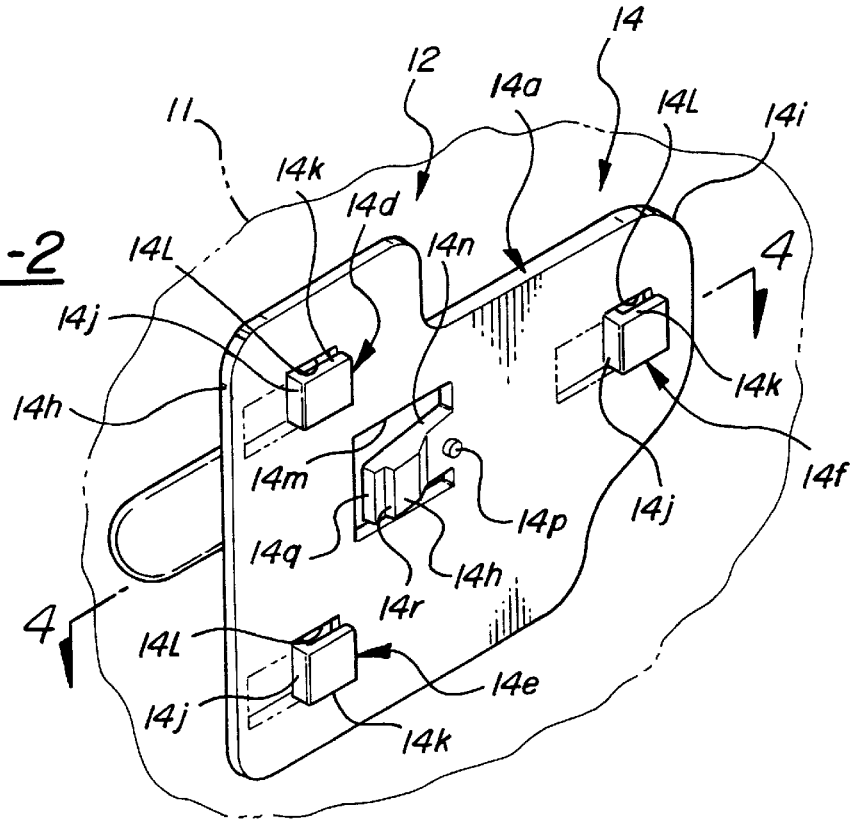
FIG. 2 is a perspective view of the door handle assembly of the invention.

The motor vehicle door 10, seen in FIG. 1, comprises the right rear door of a four door sedan type motor vehicle and includes a window opening 10*a* and an inner door skin 11. Inner skin 11 defines an outboard face 11*a* confronting the passenger compartment of the motor vehicle and an inboard face 11*b* confronting the interior of the door.

Door handle assembly 12 includes a base plate 14 and a door handle 16.

Base plate 14 is formed as a molded plastic product including a main body planar section 14*a*, laterally spaced posts 14*b* upstanding from the outboard face 14*c* of the main body planar section, lugs 14*d*, 14*e*, and 14*f* extending outwardly from the inboard face 14*g* of the main body planar section, and a spring clip 14*h*.

Lugs 14*d*, 14*e*, and 14*f* are triangulated on main body section 14*a*. Lugs 14*d* and 14*e* are positioned in laterally spaced relation proximate the forward edge 14*h* of the main body planar section and lug 14*f* is positioned proximate the rear edge 14*i* of the main body planar section.

Each lug 14*d*, 14*e*, and 14*f* defines a web portion 14*j* extending outwardly from the planar inboard face 14*g* and a rectangular flange portion 14*k* rigid with the web portion and spaced outwardly from the planar face 14*g* by approximately the thickness of skin 18. Each lug 14*d*, 14*e*, and 14*f* will be seen to open rearwardly and will be seen to be associated with a rectangular aperture 14*l* in the main body planar section.

Spring clip 14*h* has a generally rectangular configuration, is formed integrally with main body planar section 14*c*, is positioned in a rectangular aperture 14*m* in the main body section, is connected to the main body section by a living hinge 14*n*, exends forwardly in cantilever fashion from the living hinge, includes a post 14*b*, and is positioned generally between lugs 14*d* and 14*e* in longitudinal alignment with lug 14*f*. The free cantilevered end 14*q* of the spring clip defines a latching free edge 14*r*.

Handle 16 is pivotally mounted at one end 16*a* between spaced posts 14*b* by a pivot pin 18 and operates, in known manner, an associated latching mechanism for opening and closing the door.

Lugs 14*d*, 14*e* and 14*f* and spring clip 14*h* are adapted to coact with aperture means in the door skin 11 to attach the door handle assembly to the door skin.

Figure 3:
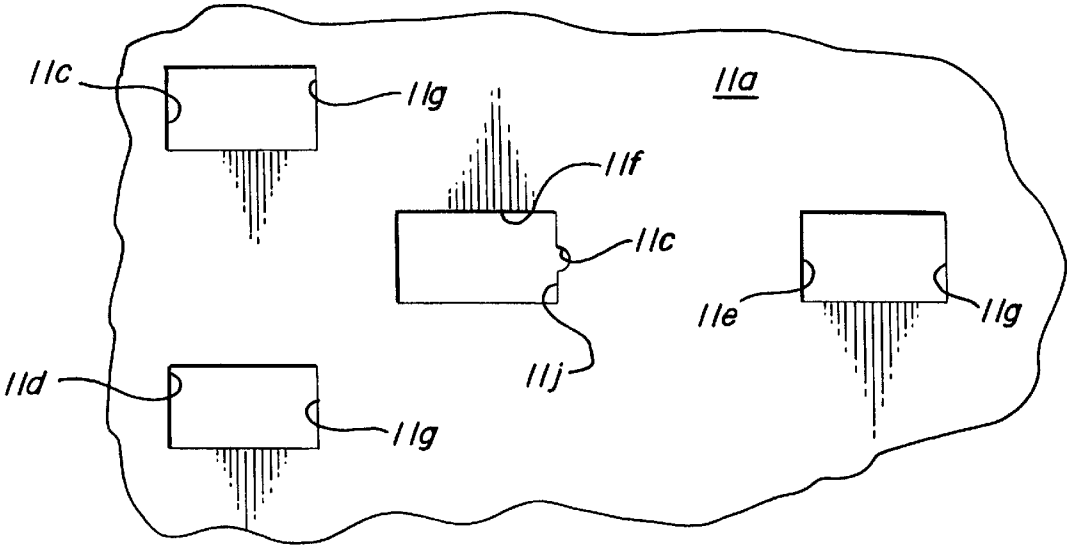
FIG. 3 is a fragmentary view taken within the circle 3 of FIG. 1.
Figure 4:
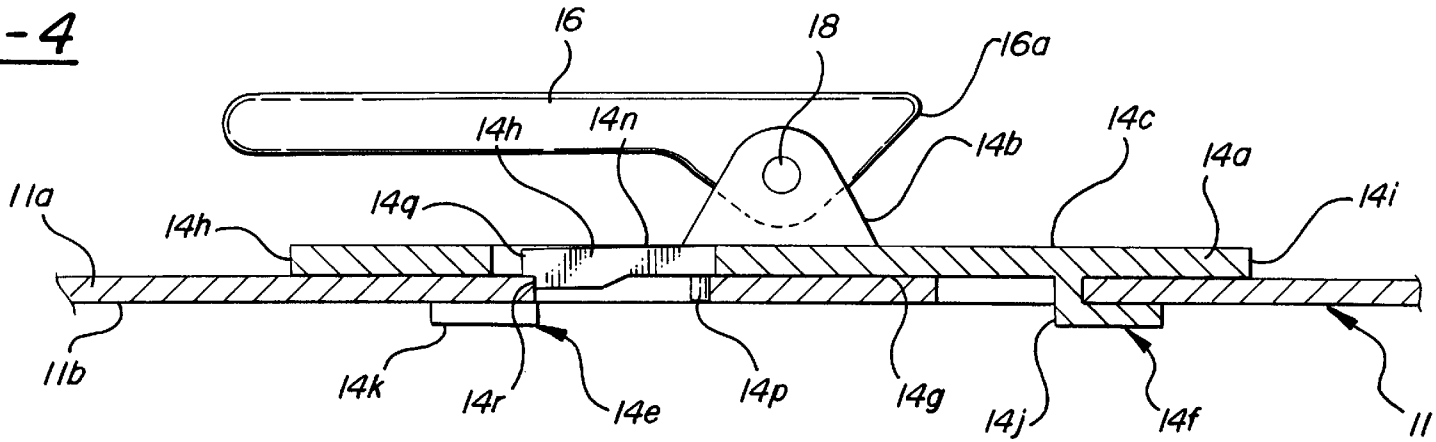
FIG. 4 is a cross sectional view taken on line 4—4 of FIG. 2.

Specifically, as best seen in FIGS. 1 and 3, the aperture means in the door skin 11 include a rectangular aperture 11*c* for coaction with lug 14*d*; a rectangular aperture 11*d* for coaction with lug 14*e*; a rectangular aperture 11*e* for coaction with lug 14*f*; and a rectangular aperture 11*f* for coaction with spring clip 14*h*. Lug apertures 11*c*, 11*d*, and 11*e* are triangulated and clip aperture 11*h* is positioned laterally between and rearwardly of lug apertures 11*c* and 11*d*.

Apertures 11*c*, 11*d*, 11*e*, and 11*f* are sized and configured to respectively pass lugs 14*d*, 14*e*, 14*f* and spring clip 14*h*. The spacing and orientation of the skin apertures relative to the spacing and orientation of the handle lugs and the handle spring clip are such that with each lug 14*d*, 14*e*, and 14*f* positioned in alignment with a respective aperture 11*c*, 11*d*, 11*e*, spring clip 14 is forwardly offset with respect to aperture 11*f*.

Figure 5:
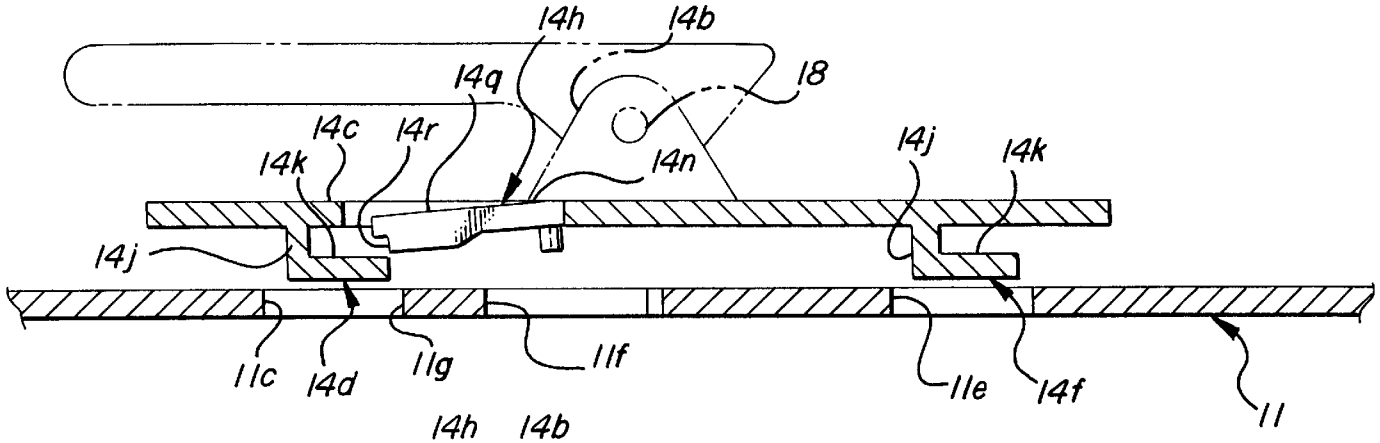
FIGS. 5, 6, and 7 are sequential views illustrating the attachment methodology of the invention.
Figure 6:
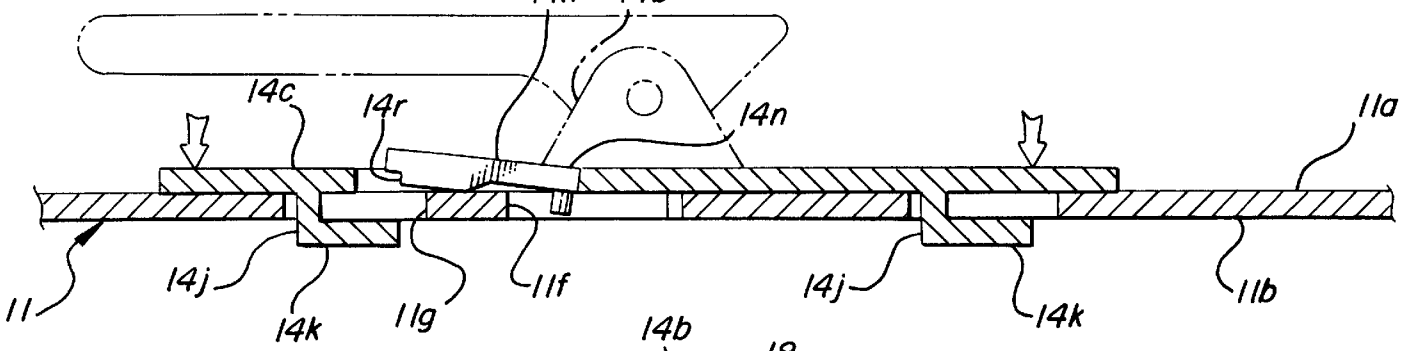
Figure 7:
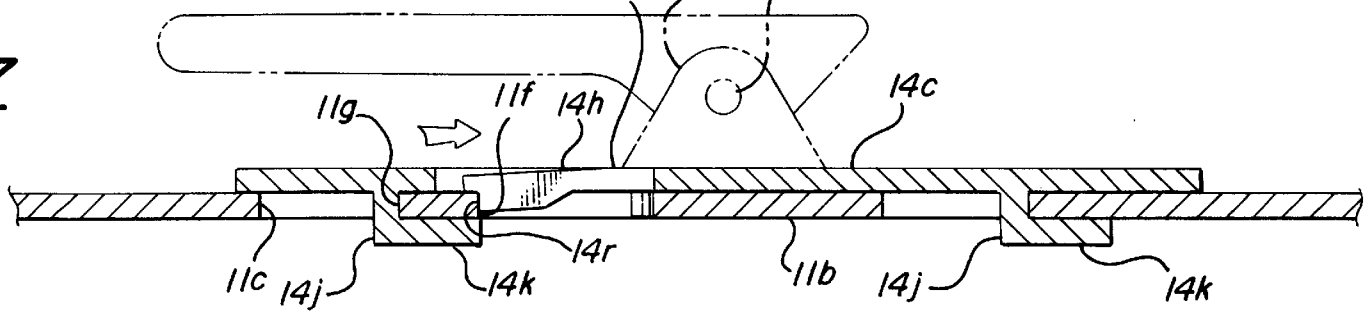

The manner in which the door handle assembly is attached to the door skin according to the methodology of the invention is best seen in sequential FIGS. 5, 6 and 7.

It will be understood that, for purposes of clarity, in FIGS. 5, 6, and 7 the spring clip 14 and the coacting aperture 11*f* have been moved rearwardly relative to lugs 14*d*, 14*e* and coacting apertures 11*c* and 11*d*. The true relative locations of the lugs and apertures and the spring clip are shown in FIGS. 1–4.

To attach the door handle assembly to the door skin 11, main body planar section 14*c* is positioned (FIG. 5) proximate the outboard face 11*a* of inner door skin 11 with lugs 14*d*, 14*e*, and 14*f* overlying apertures 11*c*, 11*d*, and 11*e* and spring clip 14*h* bearing resiliently at its free end 14*q* against skin face 11*a* forwardly of aperture 11*f*; whereafter (FIG. 6) main body planar section 14*c* is moved inwardly relative to the inner door skin to pass the lugs 14*d*, 14*e*, and 14*f* through apertures 11*c*, 11*d*, and 11*e* and flex spring clip 14*h* about its hinge axis 14*n*; whereafter (FIG. 7) main body planar section 14*c* is slid rearwardly to move the web portions 14*j* of the lugs into engagement with rear edge portions 11*g* of the associated skin aperture while moving the flange portion 14*k* of the lug beneath the inner surface 11*b* of the skin rearwardly of the respective aperture.

As the web portions 14*j* move into engagement with aperture rear edges 11*g*, spring clip 14*h* snaps inwardly into aperture 11*f* and, specifically, the latching edge 14*r* proximate the cantilevered free end 14*q* of the spring clip snaps into latching engagement with the forward latching edge 11*h* of the aperture 11*f* while post 14*p* is received in a cut-out or notch 11*i* formed in the rear edge 11*j* of aperture 11*f* to ensure that the clip edge 14*r* aligns precisely with aperture edge 11*f* and discourage dislodgement of the spring clip from the door skin.

It will be seen that, in one simple swiping movement of the door handle assembly over the door skin, the door handle assembly is firmly and positively attached to the door skin, thereby minimizing the amount of time and labor required to mount the door handle assembly on the door skin and eliminating the need for special tools or fasteners to accomplish the mounting operation, and yet providing a firm positive locking attachment of the door handle assembly to the door skin.

In the mounted configuration of the door handle assembly on the door skin, rearward movement of the door handle assembly relative to the skin is precluded by engagement of latching edge 14*r* with aperture edge 11*h*; forward movement of the door handle assembly relative to the skin is precluded by engagement of lug web portions 14*j* with aperture edges 11*g*; outward movement of the door handle assembly relative to the skin is precluded by engagement of the flange portions of the lugs with the adjacent surfaces of the skin inboard face 11*b*; and up and down movement of the door handle assembly relative to the skin is precluded by the combined action of the lug web portions against the adjacent aperture edge portions and the engagement of the spring clip free end portion 14*q* with the front transverse edge 11*h* of aperture 11*f*.

Removal of the door handle assembly from the door skin cannot be achieved from inside of the vehicle but rather can be readily achieved by a suitable tool inserted into the interior of the door behind the inner skin to move the clip 14*h* outwardly and free the clip from engagement with edge 11*h* whereafter the door handle assembly may be slid forwardly to disengage the lugs from the respective aperture surfaces and allow separation of the door handle assembly from the door.

The invention methodology will be seen to provide a rapid and efficient means of attaching a door handle assembly to a skin of the motor vehicle door with a minimum of labor and without resort to separate fasteners or tools.

Whereas a preferred embodiment of the invention has been illustrated and described in detail it will be apparent that various changes may be made in the disclosed embodiment without departing from the scope or spirit of the invention.

What is claimed is:

1. A method of mounting a motor vehicle door handle assembly on a skin of a door assembly of a motor vehicle, the skin having a thickness, the handle assembly including a handle member and a base plate defining a planar surface, the method comprising the steps of:

providing a plurality of individual, spaced apertures in the skin including a first lug aperture, a separate second lug aperture, and a third separate clip aperture;

providing first and second lugs on the base plate each sized to pass through a respective first and second lug aperture and each defining a web portion extending outwardly from the planar surface and a flange portion rigid with the web portion and spaced outwardly from the planar surface by at least the thickness of the skin;

providing a spring clip device on the base plate biased outwardly from the planar surface and including a latching free edge for latching coaction with a latching edge of the third clip aperture, the spacing and orientation of the lug and clip apertures relative to the spacing and orientation of the lugs and the spring clip being such that with each lug positioned in alignment with a respective lug aperture the spring clip is offset with respect to the clip aperture;

placing the door handle assembly on the skin with the planar surface of the base plate juxtaposed to an outer surface of the skin, the lugs passing through respective lug apertures, and the spring clip biased against a portion of the skin outer surface adjacent the third clip aperture; and moving the door handle assembly relative to the skin in a direction to move the web portion of each lug into engagement with an edge portion of a respective lug aperture, move the flange portion of each web beneath an inner surface of the skin proximate the respective lug aperture, and snap the free edge of the spring clip into latching engagement with the latching edge of the clip aperture.

2. A method according to claim 1 wherein the first and second lugs are provided in laterally spaced relation proximate one end of the base plate, a third lug is provided proximate another end of the base plate, and the spring clip device is provided proximate said one end of the base plate between said first and second spaced lugs.

3. A method according to claim 1 wherein:

the base plate is formed as a molded plastic product including a main body planar section; and the spring clip device is positioned in an aperture in the main body planar section of the base plate and is connected to the main body planar section of the base plate by a living hinge.

4. A method according to claim 1 wherein:

said third clip aperture defines a cut-out in an edge thereof opposite said latching edge; and the spring clip device includes a post that is received in said cut-out with the spring clip in latching engagement with the skin.

5. A motor vehicle door assembly comprising:

a door skin having a thickness and including a plurality of individual, spaced apertures in the skin including a first lug aperture, a second separate lug aperture, and a third separate clip aperture; and a door handle assembly including a handle member, a base plate pivotally mounting the handle member and defining a planar surface, first and second lugs on the base plate each sized to pass through a respective first and second lug aperture in the skin and each defining a web portion extending outwardly from the planar surface and a flange portion rigid with the web portion and spaced outwardly from the planar surface by at least the thickness of the skin, and a spring clip device on the base plate biased outwardly from the planar surface and including a latching free edge for latching coaction with a latching edge of the third clip aperture, the spacing and orientation of the lug and clip apertures relative to the spacing and orientation of the lugs and the spring clip being such that with each lug positioned in alignment with a respective lug aperture the spring clip is off-set with respect to the clip aperture so that the door handle assembly may be mounted on the skin by placing the door handle assembly on the skin with the planar surface of the base plate juxtaposed to an outer surface of the skin, the lugs passing through respective lug apertures, and the spring clip biased against a portion of the skin outer surface adjacent the third clip aperture and thereafter moving the door handle assembly relative to the skin in a direction to move the web portion of each lug into engagement with an edge portion of a respective lug aperture, move the flange portion of each web beneath an inner surface of the skin proximate the respective lug aperture, and snap the free edge of the spring clip into latching engagement with the latching edge of the third clip aperture.

6. A motor vehicle door assembly according to claim 5 wherein the first and second lugs are provided proximate one end of the base plate, a third lug is provided proximate another end of the base plate, a fourth separate lug aperture is provided in the skin for receipt of the third lug, and the spring clip device is provided proximate said one end of the base plate between said first and second lugs.

7. A motor vehicle door assembly according to claim 5 wherein:

the base plate is formed as a molded plastic product including a main body planar section; and the spring clip device is positioned in an aperture in the main body planar section of the base plate and is connected to the main body planar section of the base plate by a live hinge.

8. A motor vehicle door assembly according to claim 5 wherein:

the third clip aperture defines a cut-out in an edge thereof opposite said latching edge; and the spring clip device includes a post that is received in said cut-out with the spring clip in latching engagement with the skin.

* * * * *